US011019688B2

(12) United States Patent
Xiao

(10) Patent No.: US 11,019,688 B2
(45) Date of Patent: May 25, 2021

(54) DEVICE WITH ATOMIZATION FUNCTION WITH LEAKAGE PREVENTION FROM AIR INLET HOLES, AND ELECTRONIC CIGARETTE

(71) Applicant: SHENZHEN UWELL TECHNOLOGY CO., LTD., Shenzhen (CN)

(72) Inventor: Yucheng Xiao, Shenzhen (CN)

(73) Assignee: SHENZHEN UWELL TECHNOLOGY CO., LTD., Shenzhen (CN)

( * ) Notice: Subject to any disclaimer, the term of this patent is extended or adjusted under 35 U.S.C. 154(b) by 412 days.

(21) Appl. No.: 16/003,122

(22) Filed: Jun. 8, 2018

(65) Prior Publication Data

US 2019/0320715 A1 Oct. 24, 2019

(30) Foreign Application Priority Data

Apr. 18, 2018 (CN) ..... 201810349634.6

(51) Int. Cl.

| | |
|---|---|
| ***A24F 13/00*** | (2006.01) |
| ***A24F 17/00*** | (2006.01) |
| ***A24F 25/00*** | (2006.01) |
| ***H05B 3/44*** | (2006.01) |
| ***A24F 40/485*** | (2020.01) |
| *A24F 40/10* | (2020.01) |

(52) U.S. Cl.

CPC ..... *H05B 3/44* (2013.01); *A24F 40/485* (2020.01); *A24F 40/10* (2020.01); *H05B 2203/021* (2013.01)

(58) Field of Classification Search

CPC ..... A24F 47/008; A24F 40/40; A24F 40/485
USPC ..... 131/329, 328
See application file for complete search history.

(56) References Cited

U.S. PATENT DOCUMENTS

| | | | | |
|---|---|---|---|---|
| 10,582,728 | B2 * | 3/2020 | Liu | A24F 40/70 |
| 2015/0313288 | A1 * | 11/2015 | Liu | A24F 40/49 131/329 |
| 2019/0037922 | A1 * | 2/2019 | Liu | H05B 3/44 |
| 2019/0116884 | A1 * | 4/2019 | Conley | A24F 47/008 |
| 2019/0142063 | A1 * | 5/2019 | Liu | B05B 17/06 131/329 |

(Continued)

FOREIGN PATENT DOCUMENTS

| | | | | |
|---|---|---|---|---|
| CN | 207185908 | * | 2/2017 | A24F 47/008 |
| CN | 208096025 | * | 4/2018 | A24F 47/008 |

*Primary Examiner* — Abdullah A Riyami
*Assistant Examiner* — Thang H Nguyen

(57) ABSTRACT

A device with atomization function with leakage prevention from air inlet holes includes a storage tank assembly, a base assembly and an atomization core assembly. The base assembly includes a base body defining an inner hole and a base bracket defining a first vents and a first central hole which are both connected with the inlet holes. The atomization core assembly includes an atomizing portion and a separable portion. The separating portion is mounted on the atomizing portion and defines a second vent and a second central hole which are both connected with the inner hole. Wherein, the first central hole and the second central hole form a first air passage, and the first vent and the second vent form a second air passage. Therefore, the liquid at the bottom of the accommodating room can be atomized to keep the bottom of the accommodating room dry.

18 Claims, 13 Drawing Sheets

(56) References Cited

U.S. PATENT DOCUMENTS

| | | | | |
|---|---|---|---|---|
| 2019/0166905 | A1* | 6/2019 | Liu | A24F 40/05 |
| 2019/0307168 | A1* | 10/2019 | Zhao | A24F 40/485 |
| 2020/0154769 | A1* | 5/2020 | Leng | A24F 40/46 |

* cited by examiner

DEVICE WITH ATOMIZATION FUNCTION WITH LEAKAGE PREVENTION FROM AIR INLET HOLES, AND ELECTRONIC CIGARETTE

TECHNICAL FIELD

The present invention relates to substitutes of cigarette, in particular to relates to a device with an atomization function and an electronic cigarette.

DESCRIPTION OF RELATED ART

In the process of using the device with an atomization function, there may the risk of leakage when the device with the atomization function is not in use for a long period of time. If the organic cotton cannot lock the E-liquid by capillary force, the E-liquid will gradually leak into the bottom part of the base body. Once the E-liquid level is above the air inlet hole or when the device with the atomization function is placed on the side, the E-liquid will leak from the air inlet holes.

SUMMARY

In order to overcome the above problems, the purpose of the present invention is to provide an device with an atomization function that can avoid leakage from air inlet holes.

The technical solution adopted for solving technical problems of the present disclosure is:

On one hand, a device with an atomization function including a liquid storage tank assembly, a base assembly and an atomization core assembly. The base assembly includes a base body and a base bracelet installed in the base body. The base body includes an accommodating room and a plurality of inlet holes in communication with the accommodating room. The base bracelet defines at least one first vent and a first central hole, and the first vent and the first central hole are in communication with the inlet holes. The atomization core assembly is installed between the liquid storage tank assembly and the base assembly. The atomization core assembly includes an atomizing portion and a separable portion installed in the atomizing portion. The atomizing portion defines an inner hole, and the separable portion defines at least one second vent and a second central hole. The second vent and the second central hole are in communication with the inner hole. Wherein, the first central hole and the second central hole form a first air passage, and the first vent and the second vent form a second air passage.

Preferably, the atomizing portion includes an organic cotton, a heating wire, an atomizing frame and an atomizing cover. The atomizing frame defines a first inner hole, and the atomizing cover defines a second inner hole, wherein a part of the organic cotton surrounds the heating wire and the part of the organic cotton and the heating wire are received in the first inner holes, and another part of the organic cotton surrounds an outer wall of the atomizing frame and the another part of the organic cotton and the atomizing frame are received in the second inner holes, and wherein the separable portion is mounted to the atomizing cover and abuts against the organic cotton.

Preferably, the liquid storage tank assembly includes a liquid chamber a liquid chamber defining a plurality of liquid outlet holes in an inner wall thereof, the atomizing cover defines a first liquid inlet hole, the atomizing frame defines a second liquid inlet hole, wherein liquid in the liquid chamber passes through the liquid outlet hole, the first liquid inlet hole and the second liquid inlet hole and is absorbed by the organic cotton.

Preferably, the base bracket includes a bracket body and at least one protrusion extending from a lower surface of the bracket body toward the base body, and the first vent passes throughout the protrusion and the bracket body.

Preferably, the accommodating room includes a first protrusion protruding from an inner wall thereof, and the first protrusion abuts against an upper surface of the bracket body to avoid the base bracket disengaging from the base body.

Preferably, the base assembly includes a pressing portion connected with an inner wall of the accommodating room in an interference fit, and the pressing portion abut against an upper surface of the bracket body to avoid the base bracket disengaging from the base body.

Preferably, the base bracket includes a plurality of fixing posts, the base assembly further includes a plurality of elastic elements winding around the fixing posts, so that the base bracket abuts against the separable portion and a bottom surface of the protrusion is not in contact with an inner surface of a bottom of the accommodating room.

Preferably, each of the fixing posts is located on a first sidewall of the protrusion, a pair of passages is formed between the fixing post and the first sidewall of the protrusion, and the passages are in communication with the first vent to facilitate air from the inlet holes to flow into the first vents.

Preferably, the bracket body includes at least one guiding projection located on an outer circumference thereof, and the accommodating room defines at least one guiding groove located in an inner wall thereof, wherein the guiding projection slides along the guiding groove to facilitate the base bracket to mount to the accommodating room.

Preferably, the base assembly further comprises at least one supporting member received in the first vent to make the base bracket abut against the separable portion and to make a bottom surface of the protrusion is not in contact with the inner surface of the bottom of the accommodating room.

Since the device with the atomization function of the present invention is provided with the first air passage and the second air passage, the E-liquid at the bottom of the accommodating room can be formed into small droplets, mixed with air and atomized in the atomization portion. The dryness of the bottom of the accommodating room is maintained, and the troubles caused by the E-liquid leakage through the air inlet hole in the prior art are solved.

DETAILED DESCRIPTION

The present invention will be described in further detail with reference to the following figures and embodiments. It is to be understood that the specific embodiments described herein are merely illustrative of the utility model and are not intended to limit the utility model.

Figure 1:
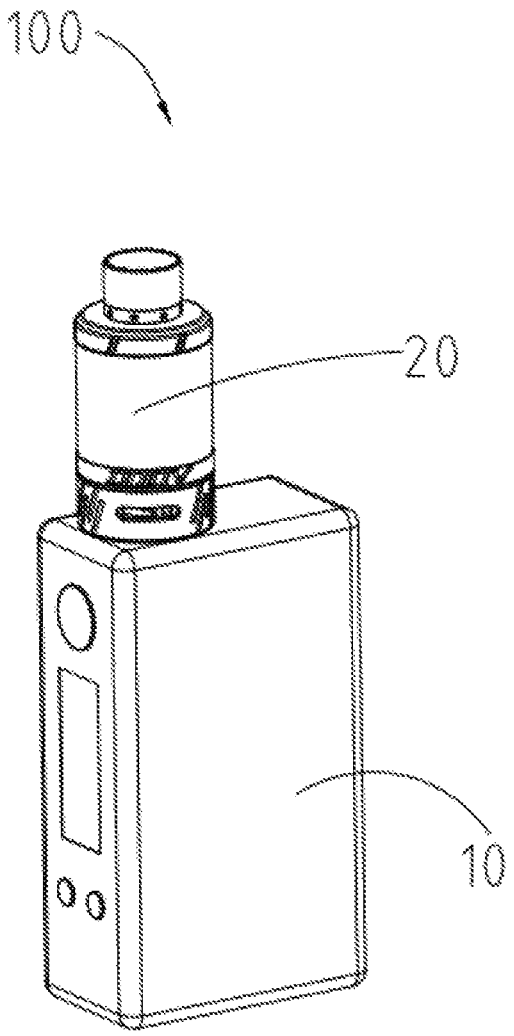
FIG. 1 is an assembled view of an electric cigarette of an exemplary embodiment of the present invention, the electric cigarette including a device with an atomization function and a battery assembly.
Figure 2:
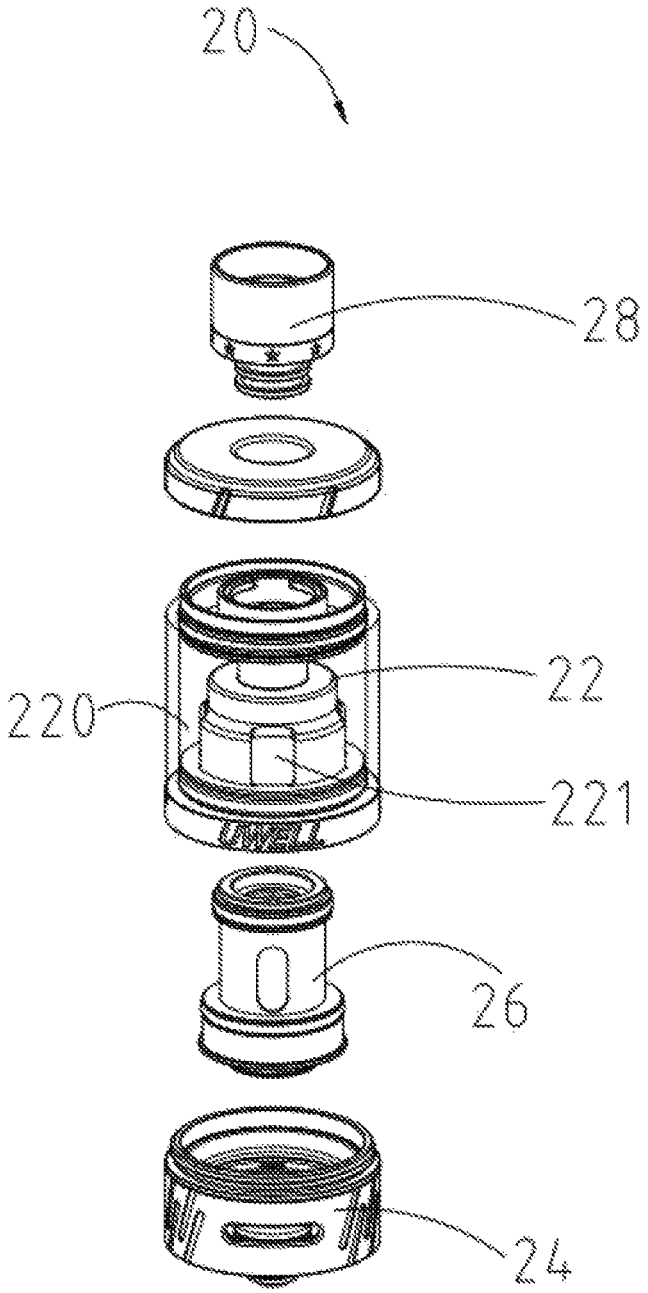
FIG. 2 is an exploded view of the device with the atomization function of FIG. 1.
Figure 3:
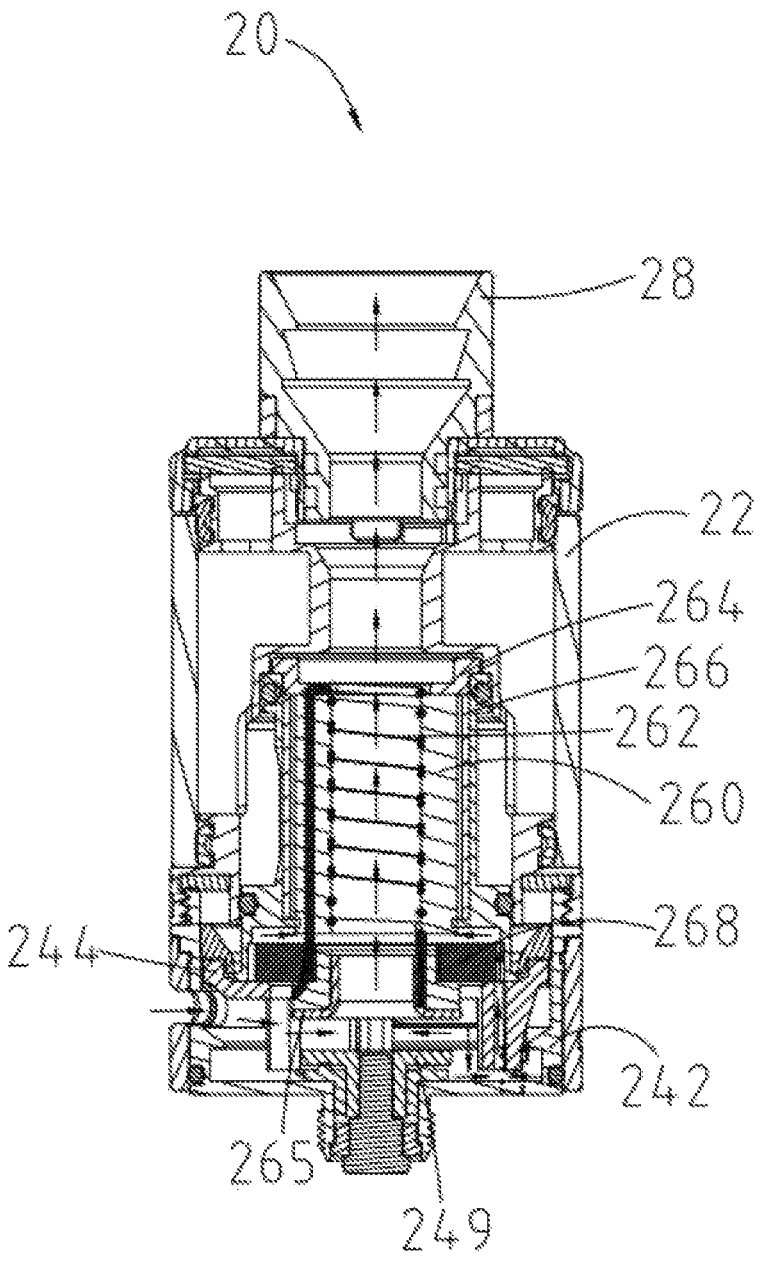
FIG. 3 is a cross-sectional view of the device with the atomization function of FIG. 2.

Referring to FIG. 1 and FIG. 2, the present invention provides an electronic cigarette 100, which includes a battery assembly 10 and a device with an atomization function 20. The battery assembly 10 is electrically connected with the device with the atomization function 20 and supplies power for the device with the atomization function 20.

Referring to FIG. 2 to FIG. 10, the device with the atomization function 20 includes a liquid storage tank assembly 22, a base assembly 24 and an atomization core assembly 26. The base assembly 24 includes a base body 242 and a base bracelet 244. The base body 242 includes an accommodating room 2420 and a plurality of inlet holes 2421. The inlet holes 2421 are in communication with accommodating room 2420. The base bracket 244 is installed in the accommodating room 2420 and defines a plurality of first vents 2441 and a first central hole 2440. The first vent 2441 and the first central hole 2440 are both in communication with the inlet hole 2421. The atomization core assembly 26 is installed between the liquid storage tank assembly 22 and the base assembly 24. The atomization core assembly 26 includes an atomizing portion 269 and a separable portion 268. The atomizing portion 269 includes an inner hole 2690. The separable portion 268 is installed on the atomizing portion 268 and defines a plurality of second vents 2681 and a second central hole 2680, and the second center hole 2680 and the second vent 2681 are both in communication with the inner hole 2690. Wherein, the first central hole 2440 and the second central hole 2680 form a first air passage, and the first vent 2441 and the second vent 2681 form a second air passage.

In use, a part of the air from the inlet hole 2421 reaches the atomizing portion 269 through the second air passage, and the other part of the air from the inlet hole 2421 reaches the atomizing portion 269 through the first air passage, that is, air from the inlet hole 2421 can reach to the atomizing portion 269 from two different air passages. Not only the air from the first central hole 2440 and the second central hole 2680 can take tiny drops of E-liquid at a bottom of the accommodating room 2420 and enter the atomizing portion 269 for atomization. At the same time, the air from the first vent 2441 and the second vent 2681 can take tiny drops of E-liquid and enter the atomizing portion 269 for atomization, which maintains the dryness of the bottom of the accommodating room 2420, thereby solves the issue of leaking through the inlet hole 2421.

Preferably, the atomizing portion 269 includes an organic cotton 260, a heating wire 262, an atomizing frame 264 and an atomizing cover 266. The atomizing frame 264 defines a first inner hole 2640, and the atomizing cover 266 defines a second inner hole 2660, a part of the organic cotton 260 surrounds the heating wire 262 and the part of the organic cotton and the heating wire 262 are received in the first inner holes 2640, and another part of the organic cotton 260 surrounds an outer wall of the atomizing frame 264 and the another part of the organic cotton 260 and the atomizing frame 264 are received in the second inner holes 2660. The second central hole 2680, the second vent 2681 are in communication with the first inner hole 2640 and the second inner hole 2660. The separable portion 268 is mounted to the atomizing cover 266 and abuts against the organic cotton 260.

Preferably, the liquid storage tank assembly 22 includes a liquid chamber 220 which defines a plurality of liquid outlet holes 221 on the inner wall. The atomizing cover 266 defines a first liquid inlet hole 2661, the atomizing frame 264 defines a second liquid inlet hole 2641, and the liquid in the liquid chamber 220 passes through the liquid outlet hole 221, the first liquid inlet hole 2661 and the second liquid inlet hole 2641 and is absorbed by the organic cotton 260.

In one embodiment, the first inner hole 2640 and the second inner hole 2660 are collectively called an inner hole 2690.

In the one embodiment, the atomizing frame 264 has the same central axis as the atomizing cover 266.

In the one embodiment, the organic cotton 260 wound around the heating wire 262 is called the first organic cotton 260; the organic cotton 260 wound around the outer wall of the atomizing frame 264 is called the second organic cotton 260. The first organic cotton 260 is higher than the second organic cotton 260 on the central axis of the atomizing cover 264, that is to say, the second organic cotton 260 is closer to the separable portion 268 to help to atomizing the E-liquid that enters atomizing portion 269 through the second air passage.

Figure 4:
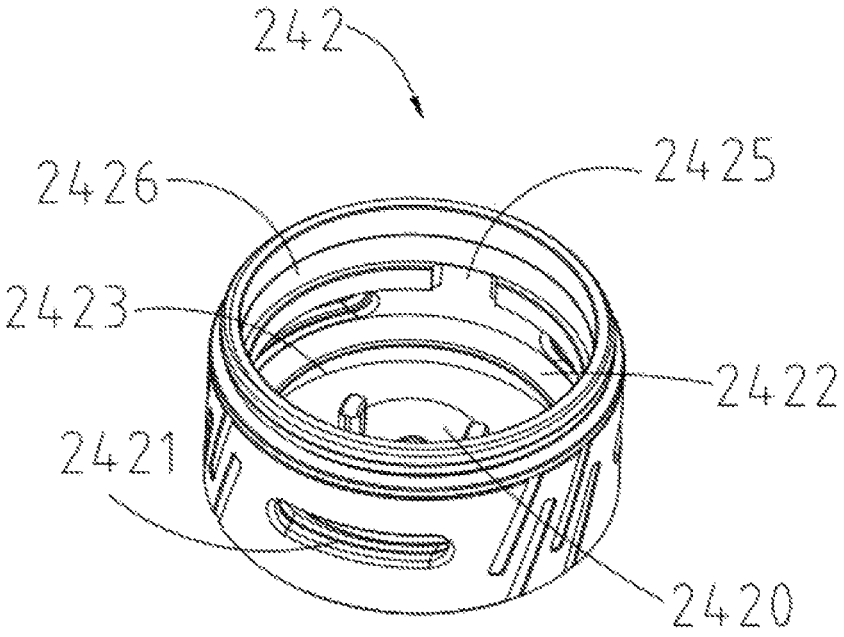
FIG. 4 is an isometric view of a base body of FIG. 2 in accordance with a first embodiment.
Figure 7:
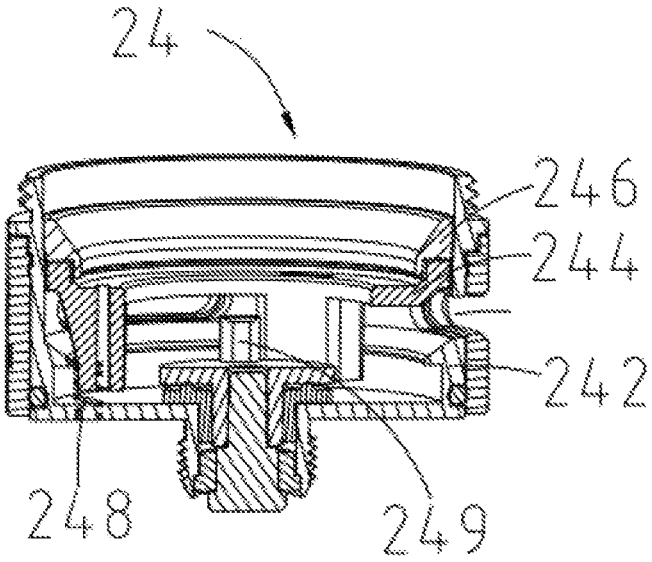
FIG. 7 is an assembled cross-sectional view of a base assembly in accordance with a second embodiment.

Referring to FIG. 4 and FIG. 7, the accommodating room 2420 is provided with a first protrusion 2423 protruding from an inner thereof, and the first protrusion 2423 is close to the inlet hole 2421 and is provided with a first sloping surface 2422 to prevent the E-liquid leaking from the inlet hole 2421. Specifically, the first sloping surface 2422 is inclined from the inner wall of the accommodating room 2420 toward the center to prevent the E-liquid that permeates into the accommodating room 2420 from the first organic cotton 260 leaking through inlet hole 2421 when user tilts the device with the atomization function 20.

Preferably, the gradient of the first sloping surface 2422 is within 10° to 90°.

Figure 5:
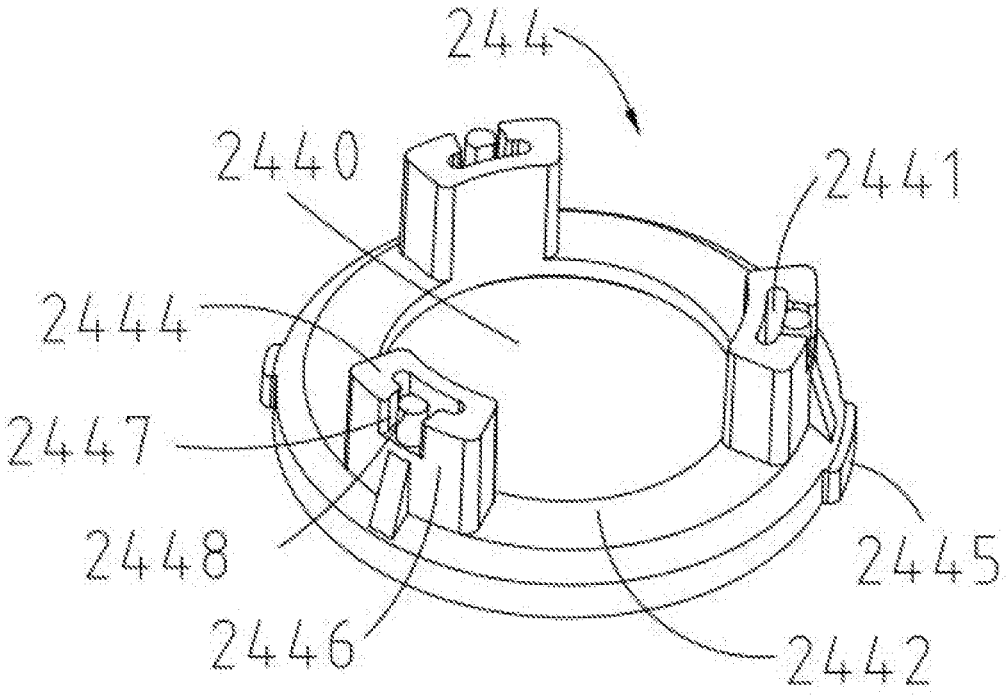
FIG. 5 is an isometric view of a base bracelet of FIG. 2 in accordance with a first embodiment.
Figure 6:
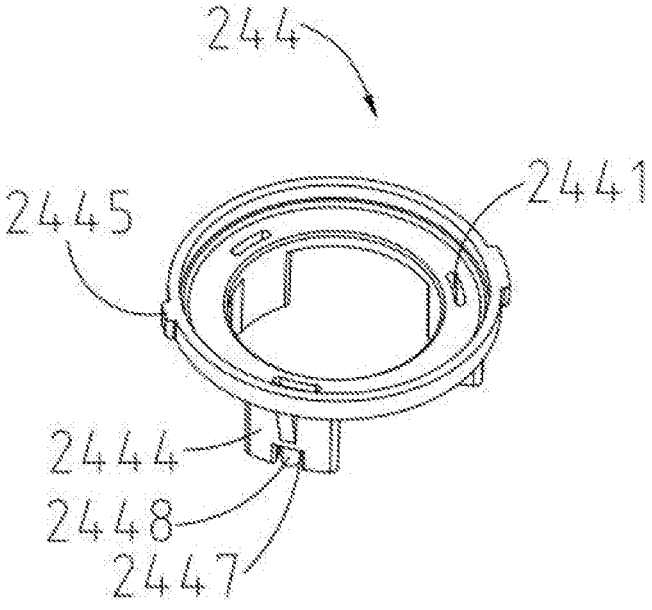
FIG. 6 is similar to FIG. 5, viewed from another aspect.

Referring to FIG. 5 and FIG. 6, the base bracket 244 includes a bracket body 2442 and at least one protrusion 2444, and the protrusion 2444 extends from a lower surface of the bracket body 2442 toward the base body 242, and the first vent 2441 passes throughout the protrusion 2444 and the bracket body 2442.

Since the protrusion 2444 protrudes from the lower surface of the bracket body 2442, that is, there is a plurality of passages between the bracket body 2442 and a bottom of the accommodating room 2420, which helps air to enter the first central hole 2440 from the inlet hole 2421 through the passages easily, and helps air to reach atomizing portion 269 through the second central hole 2680 after passing through the first central hole 2440. Meanwhile, the air passing through all these passages will mix with the tiny drops of E-liquid in the bottom of the accommodating room 2420, and pass through the first central hole 2440, the second central hole 2680 and then reach to the atomizing portion 269 for atomization, which maintains the dryness of the bottom of the accommodating room 2420 and fix the leakage from the inlet hole 2421.

Preferably, since the first vent 2441 passes throughout the protrusion 2444 and the bracket body 2442, the air from the inlet hole 2421 can enter the first vent 2441, and reach the atomizing portion 269 after passing through the second vent 2681. Meanwhile, the tiny drops of E-liquid in the bottom of the accommodating room 2420 can be mixed with the air and reach to the atomizing portion 269 for atomization.

In one embodiment, there are three first vents 2441. In other embodiment, there could be one or more first vents 2441. There are a plurality of second vents 2681 and the quantity of the second vents 2681 is more than that of the first vents 2441. The diameter of the second vent 2681 is smaller than the diameter of the first vent 2441, as a result, the air from the first vent 2441 can be dispersed to the second vents 2681 and reach to the atomizing portion 269, helping the atomization of the E-liquid absorbed in the organic cotton 260.

Preferably, since there are a plurality of first vents 2441 and second vents 2681 in the present invention; the second passage includes multiple passages. The air from inlet holes 2421 can reach to the atomizing portion 269 from different directions. Therefore, from one hand, the device with the atomization function 20 of the present invention can make the air mix with the tiny drops of E-liquid in the bottom of accommodating room 2420 and reach to the atomizing portion 269 for atomization, and therefore maintain the dryness of accommodating room 2420. On the other hand, the present invention solved the insufficient atomization of E-liquid due to single passage in the prior art.

Preferably, since the first vent 2441 is close to a sidewall of the accommodating room 2420, and the second vents 2681 are distributed on an outer circumference of the separable portion 268, so that the E-liquid attached on the inner wall of accommodating room 2420 of base body 242 can mix with air and reach to the atomizing portion 269 for atomization, and therefore further maintains the dryness of the base body 242.

Referring to FIG. 4 and FIG. 5, which is a first embodiment of fixing the base bracket 244 of the present invention. The inner wall of the accommodating room 2420 includes a first protrusion 2426. The first protrusion 2426 abuts against an upper surface of the bracket body 2442 to prevent the base bracket 244 from being disengaging from the base body 242.

In the present invention, the base bracket 244 can be fixed to the base body 242 by the first protrusion 2426, so that the base assembly 24 of the present invention has a simple structure and is easy to use, which greatly reduces the manufacturing cost.

Preferably, the inner diameter of the first protrusion 2426 is slightly smaller than or equal to the outer diameter of the bracket body 2442, therefore the base bracket 244 is secured in the accommodating room 2420. The bracket body 2442 can be pressed through the first protrusion 2426 by taking advantage of the elasticity of plastic, and since the inner diameter of the first protrusion 2426 is slightly smaller than or equal to the outer diameter of the bracket body 2442, the base bracket 244 is secured in the accommodating room 2420.

Referring to FIG. 6 and FIG. 7, which is a second embodiment of fixing the base bracket 244 of the present invention. The base assembly 24 further includes a bracket block 246, and the bracket block 246 is connected with the inner wall of the accommodating room 2420 in an interference fit, to prevent the base bracket 244 disengaging from the base body 242.

Referring to FIG. 6 and FIG. 7, the base assembly 24 further includes a plurality of elastic elements 248. The base bracket 244 comprises a plurality of fixing posts 2448. The elastic elements 248 are arranged around the fixing posts 2448 so that the base bracket 244 abuts the separable portion 268, and a bottom surface of the protrusion 2444 is not in contact with the inner surface of bottom of the accommodating room 2420.

In one embodiment, the elastic member 248 is a coil spring.

In one embodiment, the fixing post 2448 is slightly higher than the bottom surface of the protrusion 2444, which means the bottom surface of the protrusion 2444 does not contact the inner surface of bottom of the accommodating room 2420, therefore the air from the inlet hole 2421 can flow into the first vent 2441.

In other embodiments, the fixing post 2448 is slightly lower than or equal to the bottom surface of the protrusion 2444. The bottom surface of the protrusion 2444 does not contact the inner surface of bottom of the accommodating room 2420 by the force of the elastic element 248.

Preferably, the fixing posts 2448 is disposed between a first sidewall 2446 of the protrusion 2444, and a pair of channels 2447 is formed between the fixing posts 2448 and the first sidewall 2446 of the protrusion 2444, and the channels 2447 are in connected with the first vent 2441, therefore the air from the inlet hole 2421 enters the first vent 2441 more easily. Specifically, since the fixing posts 2448 have the channels 2447 on both sides, air can enter the first vent 2441 from the channels 2447, and at the same time, the protrusion 2444 are not in contact with the inner surface of bottom of the accommodating room 2420, i.e., there is a gap between the inner surfaces of bottom of the accommodating room 2420, therefore air can also enter the first vent 2441 from the gap.

Figure 11:
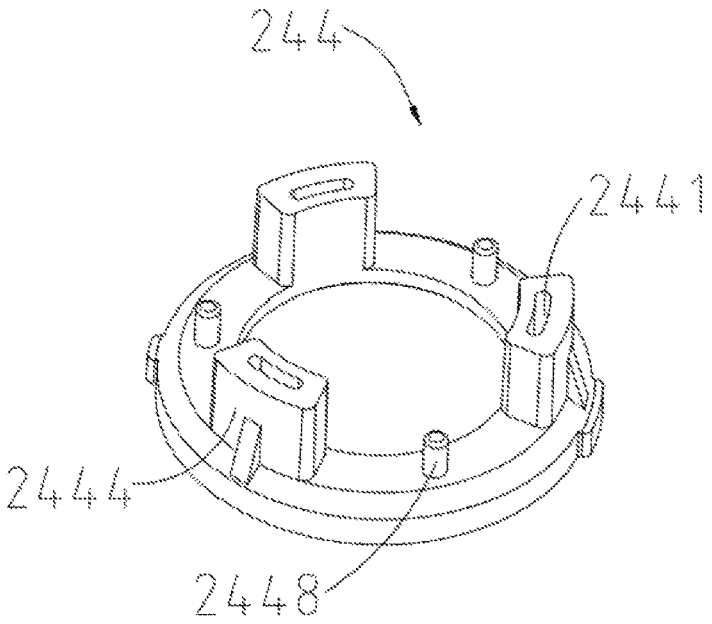
FIG. 11 is an isometric view of the base bracelet of FIG. 2 in accordance with a second embodiment.
Figure 12:
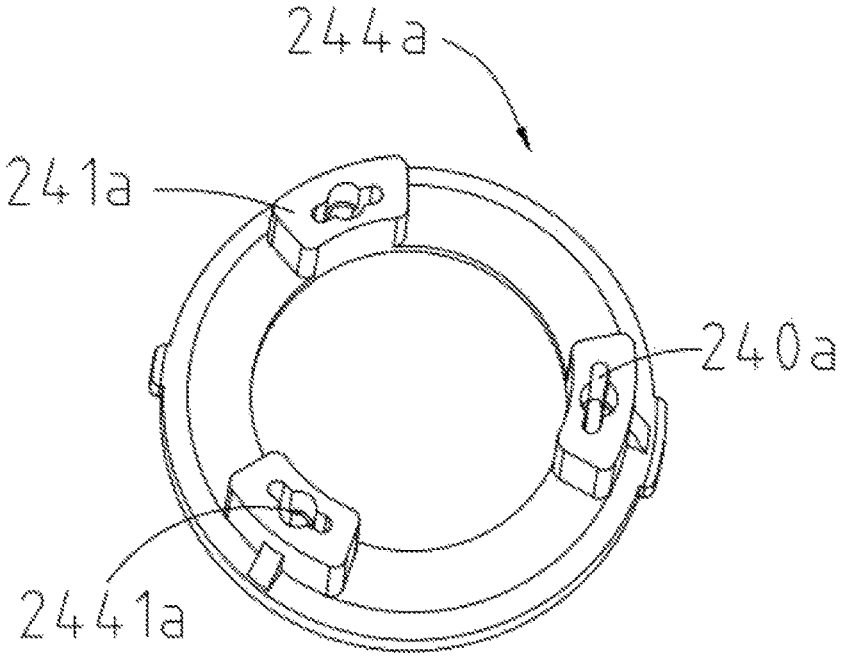
FIG. 12 is an isometric view of the base bracelet of FIG. 2 in accordance with a third embodiment.
Figure 13:
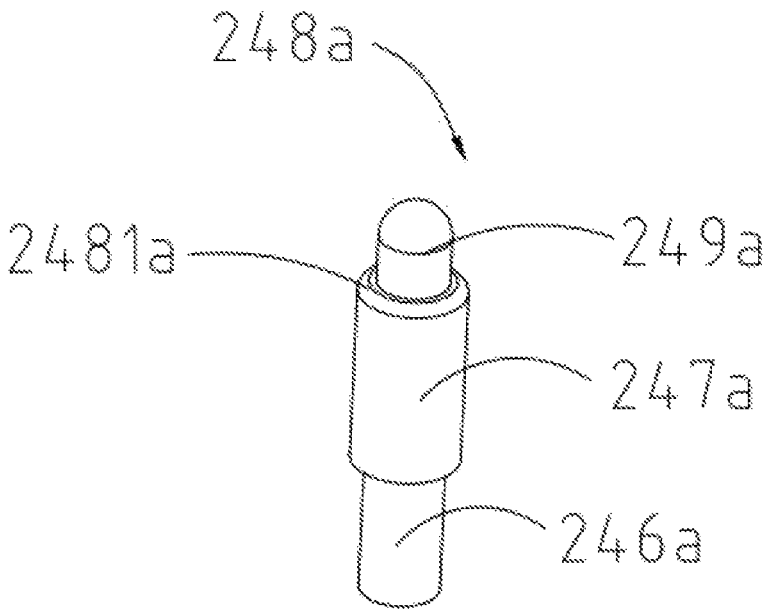
FIG. 13 is an isometric view a flexible element of FIG. 2 in accordance with a second embodiment.
Figure 14:
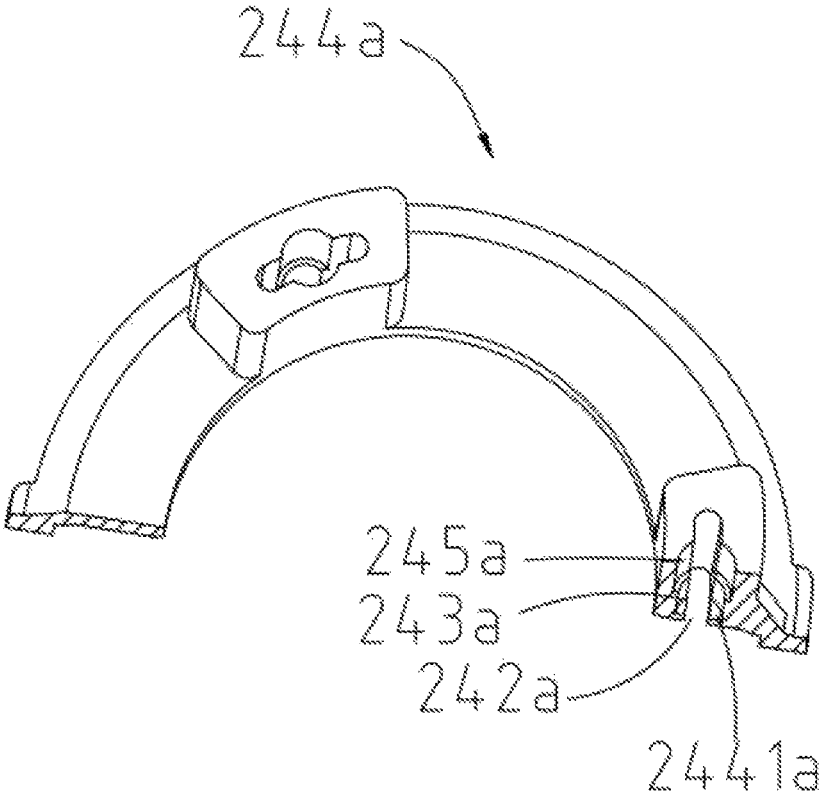
FIG. 14 is a cross-sectional view of the base bracket of FIG. 12.
Figure 15:
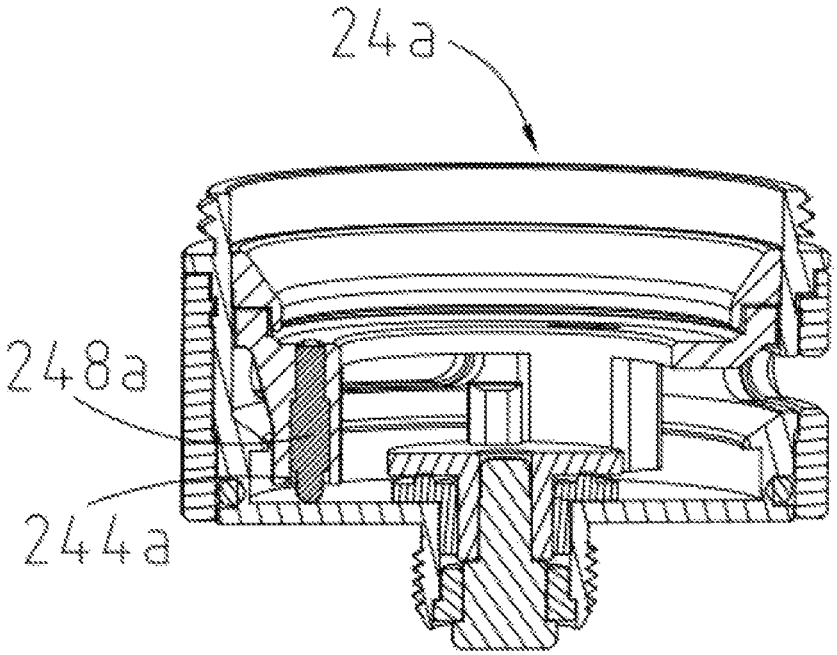
FIG. 15 is an assembled cross-sectional view of the base bracket of FIG. 12 and the elastic element of FIG. 13.

Referring to FIG. 11, in other embodiments, the fixing posts 2448 may also be disposed between the two protrusions 2444. That is, the fixing posts 2448 protrude from a bottom surface of the bracket body 2442.

Referring to FIG. 12 to FIG. 15, which is a third embodiment of the base assembly 24*a* of the present invention. In one embodiment, the base assembly 24*a* further includes at least one supporting member 248*a*, and the supporting member 248*a* is disposed in the first vent 240*a*, the base bracket 244*a* abuts against the separable portion 268 (please referring to FIG. 3), and the bottom surface of the protrusion 241*a* is not in contact with the bottom of inner surface of accommodating room 2420 (please referring to FIG. 4).

The supporting member 248*a* includes a supporting portion 249*a*, an intermediate portion 247*a* and an abutment portion 246*a*. The intermediate portion 247*a* connects the supporting portion 249*a* and the abutment portion 246*a*, and the intermediate portion 247*a* has a larger diameter than the supporting portion 249*a* and the abutment portion 246*a*, the first vent 240*a* is provided with a first receiving groove 245*a*, a second receiving groove 242*a*, and an intermediate receiving groove 243*a*. The supporting portion 249*a* is disposed in the first receiving portion 245*a*. The abutment portion 246*a* is disposed in the second receiving groove 242*a*, and the intermediate portion 247*a* is disposed in the receiving groove 243*a*.

In one embodiment, the supporting portion 249*a* is elastic.

Preferably, the supporting member 248*a* comprises a pair of first steps 2481*a*, one of the first steps 2481*a* is located at a boundary between the supporting member 249*a* and the intermediate portion 247*a*, and the other first step 2481*a* is located at a boundary between the abutment portion 246*a* and the intermediate portion 247*a*. The first vent 240*a* defines a pair of second steps 2441*a*, one of the second steps 2441*a* is located at a boundary between the first receiving groove 245*a* and the middle receiving groove 243*a*, and the other step is located at a boundary between the second receiving groove 242*a* and the intermediate receiving groove 243*a*. When installed, the first steps 2481*a* each abut against the second step 2441*a*.

Preferably, the cross section of the first vent 240*a* is an irregular shape with a large middle and two small ends. After the supporting member 248*a* is installed in the first vent 240*a*, the air from the inlet hole 2421 reaches to the first vent 240*a* from both ends of the cross section of the first vent 240*a*, therefore, air will not be prevented from entering the first vent 240*a* due to the supporting member 248*a* being attached to the first vent 240*a*.

Referring to FIG. 4, FIG. 5 and FIG. 6, at least one guiding projection 2445 protrudes from outer circumference of the bracket body 2442. The inner wall of the accommodating room 2420 defines at least one guiding groove 2426. The guiding projection 2445 slide along the guiding groove 2426 so that the base bracket 244 can be installed in the accommodating room 2420. Meanwhile, the guiding projection 2445 plays a role of limiting and orienting within the guiding groove 2426 to prevent the bracket body 2442 from rotating axially and affecting the air flow.

Figure 8:
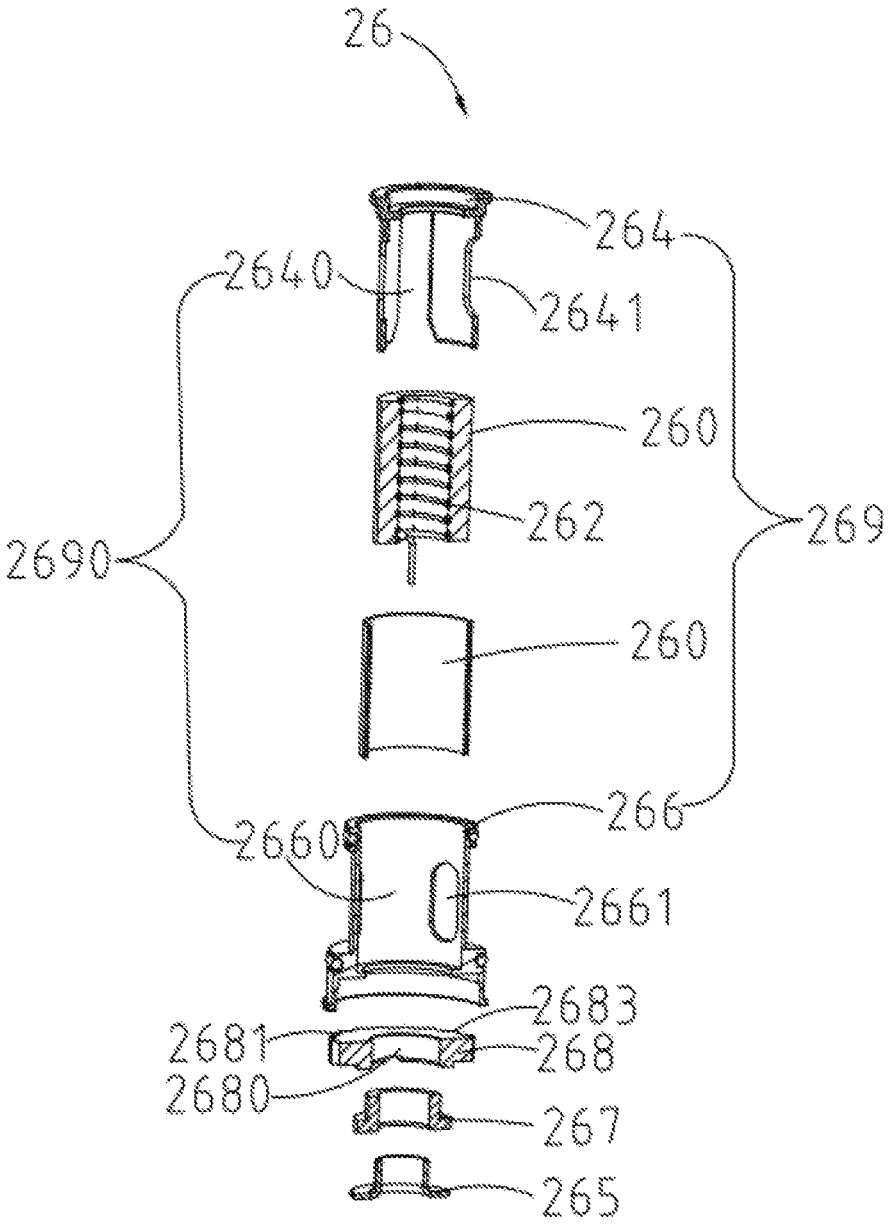
FIG. 8 is an exploded view of an atomization core assembly of FIG. 2.
Figure 9:
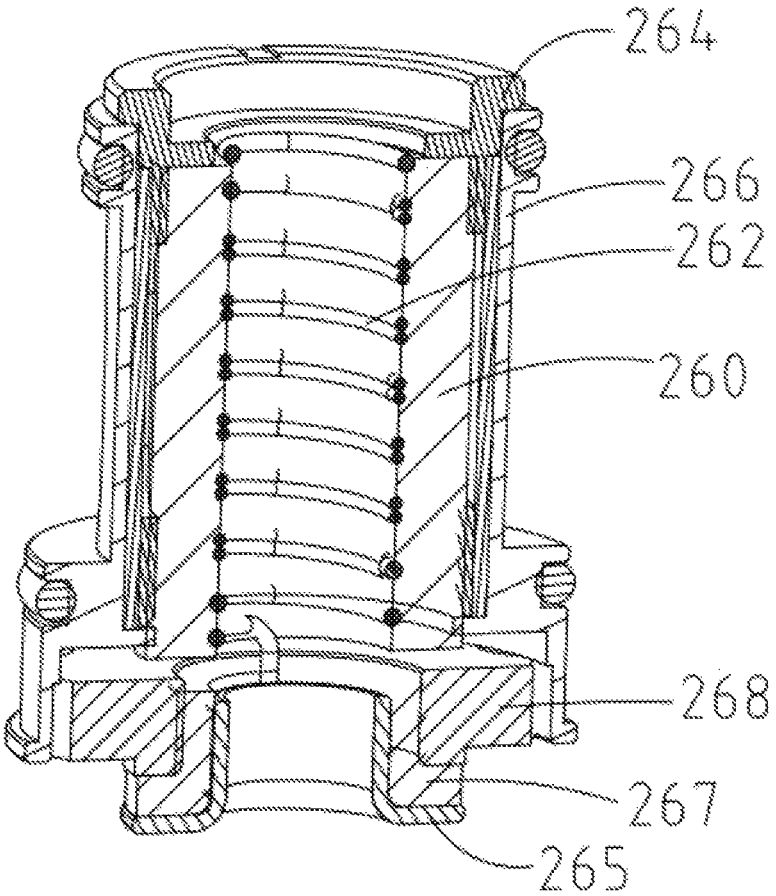
FIG. 9 is an assembled cross-sectional view of the atomization core assembly of FIG. 8.
Figure 10:
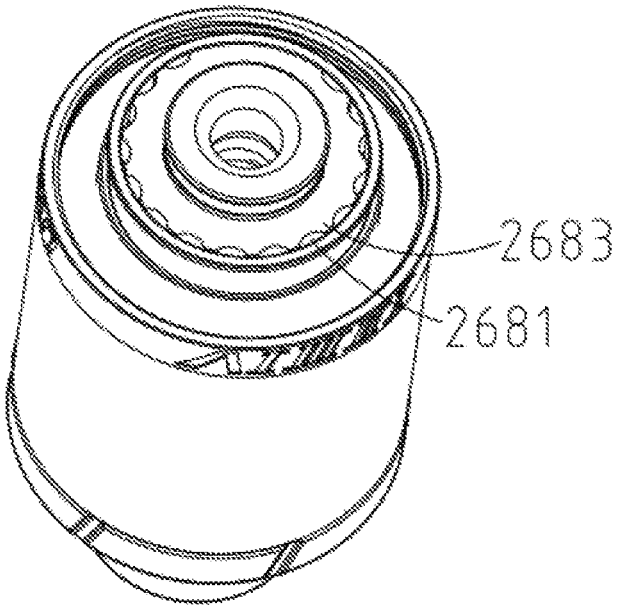
FIG. 10 is an assembled view of the device with the atomization function of FIG. 2 in accordance with a first embodiment, not shown the base assembly.

Referring to FIG. 8 and FIG. 10, a plurality of flange ribs 2683 are disposed on an outer circumference of the separable portion 268, and the second vent 2681 is disposed between two adjacent two flange ribs 2683.

Referring to FIG. 1 and FIG. 2, the device 20 with atomization function further includes a cigarette holder 28 mounted on the liquid storage tank assembly 22.

Preferably, referring to FIGS. 1, 3, 8 and 9, the atomization core assembly 26 further includes a atomization core electrode 265 and an insulating pad 267. The insulating pad 267 is located at the separable portion 268 and the atomization core electrodes 265. The negative electrode pin of the heating wire 262 is closely attached to the inner wall of the second central hole 2680 of the separable portion 268. The positive electrode pin of the heating wire 262 and the outer periphery of the atomization core electrode 265 are closely adhered; therefore, the atomizing cover 266 would be the negative electrode connection end of the atomization core assembly 26, atomization core electrode 265 is the positive electrode connection end of the atomization core assembly 26. The base assembly 24 is connected with the electrode base on the battery assembly 10 to form a negative electrode; the atomization core electrode 265 is attached to the electrode joint 249 on the base assembly 24, and is connected with the electrode on the battery assembly 10 through the electrode joint 249 to form a positive electrode.

Referring to FIGS. 1 to 10, in assembly, the base bracket 244 is installed in the base body 242 to be assembled as the base assembly 24; the organic cotton 260 is wrapped around the heating wire 262, placed in the atomizing frame 264 and surrounded by the first inner hole 2640; the outer wall of the atomizing frame 264 is wrapped around by the organic cotton 260, and surrounded by the second inner hole 2660 of the atomizing cover 266. The separable portion 268 is mounted on the inner wall of the second inner hole 2660 and is close to the atomizing frame 264 to be assembled into the atomization core assembly 26; then the atomization core assembly 26 is mounted between the liquid storage tank assembly 22 and the base assembly 24; and the cigarette holder 28 is then mounted to the liquid storage tank assembly 22, ultimately, the cigarette holder 28, the liquid storage tank assembly 22, the base assembly 24, and the atomization core assembly 26 are assembled to be the device with the atomization function 20. Finally, the device with the atomization function 20 is mounted on the battery assembly 10 to be assembled into the electronic cigarette 100.

In use, the E-liquid is added to the liquid storage tank 220 of the liquid storage tank assembly 22. The E-liquid is absorbed by the organic cotton 260 through the liquid outlet hole 221, the first liquid inlet hole 2661 and the second liquid inlet hole 2641, once the electronic cigarette 100 is energized, the air enters the base body 242 from the air inlet 2421, and reaches the atomizing portion 269 from the first air passage and the second air passage. The E-liquid in the atomizing portion 269 is atomized due to heat generated by the heating wire 262.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A device with an atomization function, comprising:

a liquid storage tank assembly;

a base assembly, comprising a base body and a base bracelet installed in the base body, the base body comprising an accommodating room and a plurality of inlet holes in communication with the accommodating room, the base bracelet defining at least one first vent and a first central hole, the first vent and the first central hole in communication with the inlet holes; and an atomization core assembly located between the liquid storage tank assembly and the base assembly, the atomization core assembly comprising an atomizing portion and a separable portion installed in the atomizing portion, the atomizing portion defining an inner hole, the separable portion defining at least one second vent and a second central hole, the second vent and the second central hole in communication with the inner hole;

wherein the first central hole and the second central hole form a first air passage;

wherein the atomizing portion comprises an organic cotton, a heating wire, an atomizing frame, and an atomizing cover; the atomizing frame defines a first inner hole, and the atomizing cover defines a second inner hole, wherein a part of the organic cotton surrounds the heating wire and the part of the organic cotton and the heating wire are received in the first inner holes, and another part of the organic cotton surrounds an outer wall of the atomizing frame and the another part of the organic cotton and the atomizing frame are received in the second inner holes, and wherein the separable portion is mounted to the atomizing cover and abuts against the organic cotton.

2. The device with the atomization function as claimed in claim 1, wherein the liquid storage tank assembly comprises a liquid chamber defining a plurality of liquid outlet holes in an inner wall thereof, the atomizing cover defines a first liquid inlet hole, the atomizing frame defines a second liquid inlet hole, wherein liquid in the liquid chamber passes through the liquid outlet hole, the first liquid inlet hole and the second liquid inlet hole and is absorbed by the organic cotton.

3. The device with the atomization function as claimed in claim 1, wherein the base bracket comprises a bracket body and at least one protrusion extending from a lower surface of the bracket body toward the base body, and the first vent passes throughout the protrusion and the bracket body.

4. The device with the atomization function as claimed in claim 3, wherein the accommodating room comprises a first protrusion protruding from an inner wall thereof, and the first protrusion abuts against an upper surface of the bracket body to avoid the base bracket disengaging from the base body.

5. The device with the atomization function as claimed in claim 3, wherein the base assembly comprises a pressing portion connected with an inner wall of the accommodating room in an interference fit, and the pressing portion abut against an upper surface of the bracket body to avoid the base bracket disengaging from the base body.

6. The device with the atomization function as claimed in claim 3, wherein the base bracket comprises a plurality of fixing posts, the base assembly further comprises a plurality of elastic elements winding around the fixing posts, so that the base bracket abuts against the separable portion and a bottom surface of the protrusion is not in contact with an inner surface of a bottom of the accommodating room.

7. The device with the atomization function as claimed in claim 6, wherein each of the fixing posts is located on a first sidewall of the protrusion, a pair of passages is formed between the fixing post and the first sidewall of the protrusion, and the passages are in communication with the first vent to facilitate air from the inlet holes to flow into the first vents.

8. The device with the atomization function as claimed in claim 3, wherein the bracket body comprises at least one guiding projection located on an outer circumference thereof, and the accommodating room defines at least one guiding groove located in an inner wall thereof, wherein the guiding projection slides along the guiding groove to facilitate the base bracket to mount to the accommodating room.

9. The device with the atomization function as claimed in claim 3, wherein the base assembly further comprises at least one supporting member received in the first vent to make the base bracket abut against the separable portion and to make a bottom surface of the protrusion is not in contact with the inner surface of the bottom of the accommodating room.

10. An electronic cigarette, comprising a battery assembly; and a device with an atomization function electrically connected to the battery assembly, the device with the atomization function comprising:

a liquid storage tank assembly;

a base assembly, comprising a base body and a base bracket, the base body comprising an accommodating room and a plurality of inlet holes in communication with the accommodating room; wherein the base bracket is mounted in the accommodating room and comprises a first vent and a first central hole, and the first vent and the first central hole are in communication with the inlet hole; and an atomization core assembly mounted between the liquid storage tank assembly and the base assembly, the atomization core assembly comprising an atomizing portion and a separable portion, the atomizing portion defining an inner hole, the separable portion installed in the atomizing portion, the atomizing portion defining a second vent and a second central hole, the second central hole and the second vent in communication with the inner hole;

wherein the first central hole and the second central hole form a first air passage;

wherein the atomizing portion comprises an organic cotton, a heating wire, an atomizing frame, and an atomizing cover, the atomizing frame defines a first inner hole, and the atomizing cover defines a second inner hole, wherein a part of the organic cotton surrounds the heating wire and the part of the organic cotton and the heating wire are received in the first inner holes, and another part of the organic cotton surrounds an outer wall of the atomizing frame and the another part of the organic cotton and the atomizing frame are received in the second inner holes, and wherein the separable portion is mounted to the atomizing cover and abuts against the organic cotton.

11. The electronic cigarette as claimed in claim 10, wherein the liquid storage tank assembly comprises a liquid chamber defining a plurality of liquid outlet holes in an inner wall thereof, the atomizing cover defines a first liquid inlet hole, the atomizing frame defines a second liquid inlet hole, wherein liquid in the liquid chamber passes through the liquid outlet hole, the first liquid inlet hole and the second liquid inlet hole and is absorbed by the organic cotton.

12. The electronic cigarette as claimed in claim 10, wherein the base bracket comprises a bracket body and at least one protrusion extending from a lower surface of the bracket body toward the base body, and the first vent passes throughout the protrusion and the bracket body.

13. The electronic cigarette as claimed in claim 12, wherein the accommodating room comprises a first protrusion protruding from an inner wall thereof, and the first protrusion abuts against an upper surface of the bracket body to avoid the base bracket disengaging from the base body.

14. The electronic cigarette as claimed in claim 12, wherein the base assembly comprises a pressing portion connecting with an inner wall of the accommodating room in an interference fit, and the pressing portion abut against an upper surface of the bracket body to avoid the base bracket disengaging from the base body.

15. The electronic cigarette as claimed in claim 12, wherein the base bracket comprises a plurality of fixing posts, the base assembly further comprises a plurality of elastic elements winding around the fixing posts, so that the base bracket abuts against the separable portion and a bottom surface of the protrusion is not in contact with an inner surface of a bottom of the accommodating room.

16. The electronic cigarette as claimed in claim 15, wherein each of the fixing posts is located on a first sidewall of the protrusion, a pair of passages is formed between the fixing post and the first sidewall of the protrusion, and the passages are in communication with the first vent to facilitate air from the inlet holes to flow into the first vents.

17. The electronic cigarette as claimed in claim 12, wherein the bracket body comprises at least one guiding projection located on an outer circumference thereof, and the accommodating room defines at least one guiding groove located in an inner wall thereof, wherein the guiding projection slides along the guiding groove to facilitate the base bracket to mount to the accommodating room.

18. The electronic cigarette as claimed in claim 12, wherein the base assembly further comprises at least one supporting member received in the first vent to make the base bracket abut against the separable portion and to make a bottom surface of the protrusion is not in contact with the inner surface of the bottom of the accommodating room.

* * * * *